US007252220B1

(12) United States Patent
Shreve

(10) Patent No.: US 7,252,220 B1
(45) Date of Patent: Aug. 7, 2007

(54) ANTITHEFT MAILBOX

(76) Inventor: Don C. Shreve, 2017 Hubbard Rd., Macon, GA (US) 31217

( * ) Notice: Subject to any disclaimer, the term of this patent is extended or adjusted under 35 U.S.C. 154(b) by 0 days.

(21) Appl. No.: 10/903,682

(22) Filed: Aug. 2, 2004

(51) Int. Cl.
*B65G 11/04* (2006.01)

(52) U.S. Cl. ..... 232/45; 232/47; 232/39; 232/29

(58) Field of Classification Search ..... 232/45, 232/47, 39, 29, 33, 17, 24, 27, 43.1, 20; D99/29
See application file for complete search history.

(56) References Cited

U.S. PATENT DOCUMENTS

| | | | | | |
|---|---|---|---|---|---|
| 3,880,344 | A | * | 4/1975 | Earle | 232/17 |
| 4,753,386 | A | * | 6/1988 | Phillion, Sr. | 232/43.1 |
| 4,869,425 | A | * | 9/1989 | Chiou | 232/17 |
| 4,905,891 | A | * | 3/1990 | Wildish et al. | 232/17 |
| 5,071,063 | A | * | 12/1991 | Overstreet | 232/17 |
| 5,096,115 | A | * | 3/1992 | Hassan | 232/17 |
| 5,207,377 | A | * | 5/1993 | Brecht | 232/17 |
| 5,526,979 | A | * | 6/1996 | Mann | 232/33 |
| 5,833,132 | A | * | 11/1998 | Bachmeier | 232/47 |
| 5,938,113 | A | * | 8/1999 | Kim | 232/47 |
| 5,992,736 | A | * | 11/1999 | Parker | 232/17 |
| 6,109,519 | A | * | 8/2000 | McClure | 232/17 |
| 6,234,388 | B1 | * | 5/2001 | Taylor | 232/47 |
| 6,244,505 | B1 | * | 6/2001 | Grimes et al. | 232/47 |
| 6,247,642 | B1 | * | 6/2001 | Wilson, Jr. | 232/47 |
| D468,887 | S | * | 1/2003 | Shreve | D99/29 |
| 6,722,561 | B1 | * | 4/2004 | Thomas et al. | 232/39 |
| 6,772,939 | B1 | * | 8/2004 | Simpson | 232/38 |

* cited by examiner

*Primary Examiner*—William L. Miller
(74) *Attorney, Agent, or Firm*—Rodgers & Rodgers

(57) ABSTRACT

A mailbox comprising side and back walls, a top and a bottom secured together to form an enclosure, a front access door mounted to the front wall, a rear access door connected to the rear access door, and a tray accessible through the front access door and vertically adjustable.

6 Claims, 2 Drawing Sheets

ANTITHEFT MAILBOX

Conventional mailboxes are typically simply a mail receiving container with a hinged door for gaining access to the mailbox. Of course, items such as charge cards, bank information, social security numbers, checks, etc., are sent through the mail and simply placed in a mailbox by the mail carrier. Naturally, the deposited items in the mailbox are easily accessed by mailbox vandals.

Attempts have been made to make mailboxes more secure such as large brick enclosures which are banned in many areas. In addition, brick enclosures create liabilities for the owner when the enclosure is struck by a motor vehicle.

SUMMARY OF THE INVENTION

By this invention, the mailbox is provided having front, side and back walls, a bottom and a top interconnected to form an enclosure, a front access door hingedly connected to the front wall and a rear access door hingedly connected to the back wall. A tray is removably positioned on flanges and is positionable at various heights and accessible through the front access door. Another tray is removably positioned on flanges and accessible through the rear access door. Also, water channels extend along the side edges of the front access door.

DETAILED DESCRIPTION OF THE INVENTION

Figure 1:
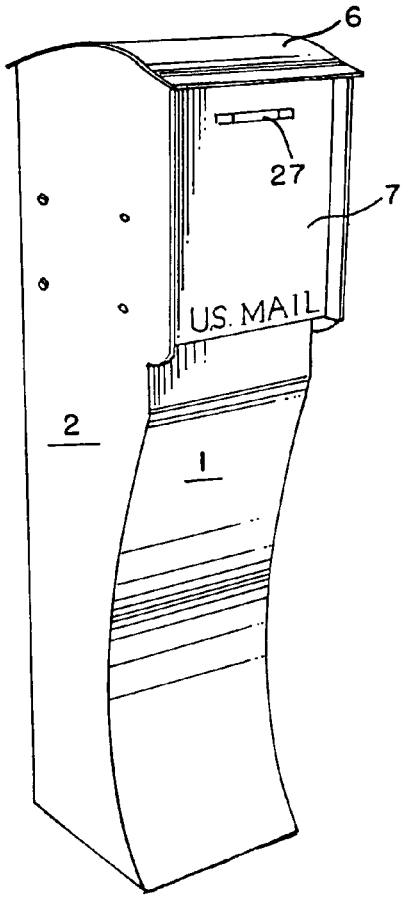
FIG. 1 is a perspective view of a mailbox according to this invention.
Figure 2:
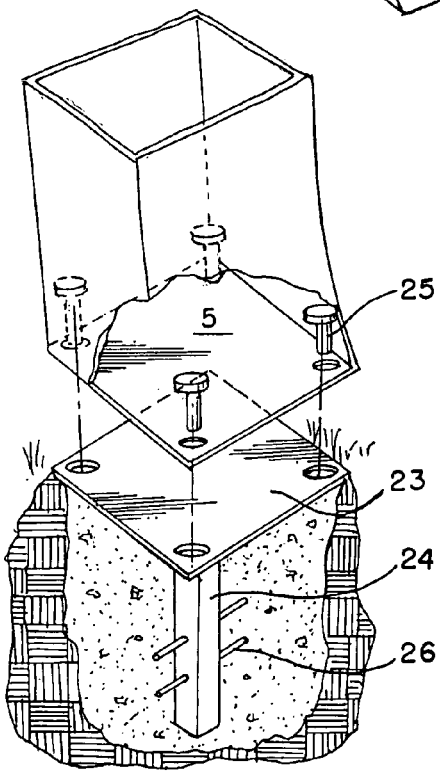
FIG. 2 is an enlarged perspective view of the mailbox mounting means.

In the drawings, the numeral 1 designates the curved front wall of the mailbox with side walls 2 and 3 extending perpendicularly from the side edges thereof. Back wall 4 is secured to the rear edges of perpendicular side walls 2 and 3. To complete the basic enclosure, bottom 5 is secured to the lower edges of front, side and back walls 1–4 and top 6 is secured to the upper edges of side walls 2 and 3 and back wall 4.

Figure 3:
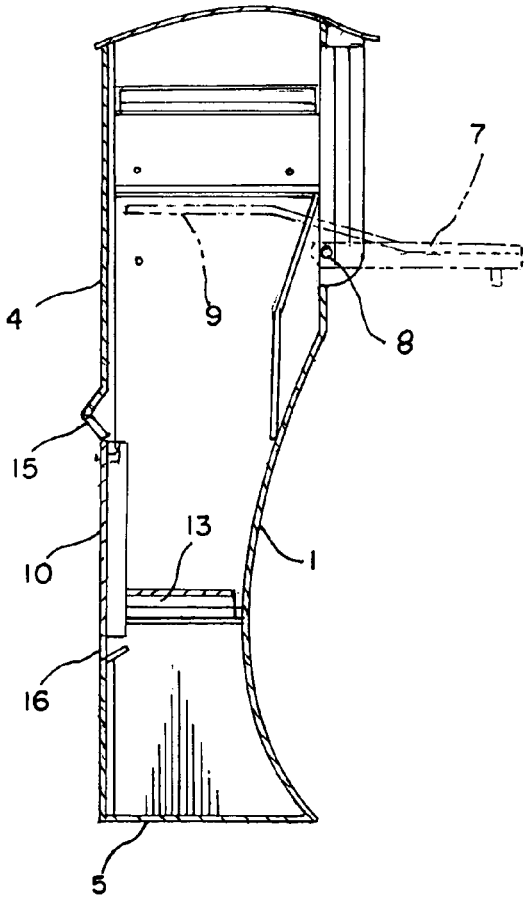
FIG. 3 is a side elevational view of the mailbox with one side wall broken away.

Front access door 7 is hingedly connected to the upper portion of front wall 1 by means of hinge 8 and security barrier 9 is secured to the inner surface of front access door 7 and extends into the mailbox. Security barrier 9 extends generally vertically downward when access door 7 is closed. When access door 7 is opened, as shown by dotted lines in FIG. 3, security barrier 9 is rotated upwardly so as to prevent access to any mail disposed therebelow.

For the purpose of gaining access to the interior of the mailbox, rear access door 10 is rotatably connected to back wall 4 by means of hinge 11. When rear access door 10 is in the closed position, it can be locked by means of conventional locking mechanism 12.

Figure 5:
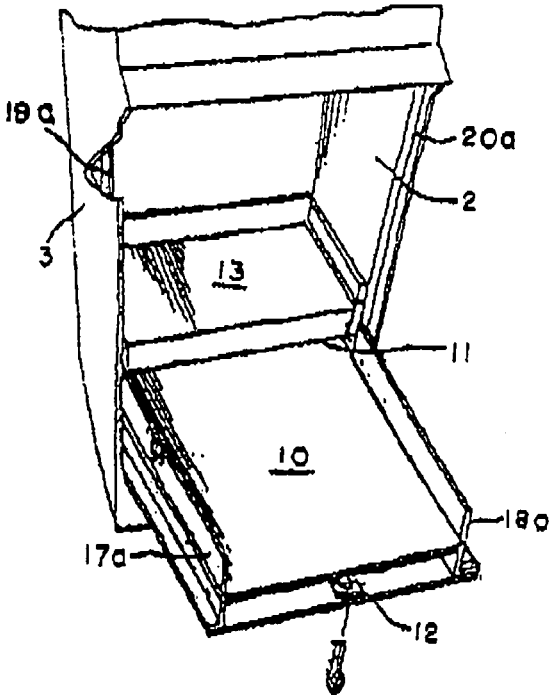
FIG. 5 is a perspective view showing the rear access means for the mailbox.
Figure 6:
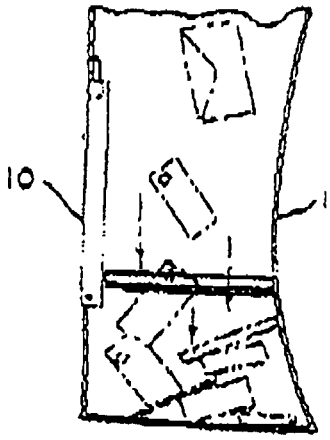
FIG. 6 is a side elevational view depicting a portion of the interior of the mailbox.

If it is desired that mail not fall all the way to the bottom of the mailbox, tray 13 is positioned on flanges secured to the interior of the mailbox and which are disposed generally adjacent the lower edge of rear access door 10 and as best shown in FIG. 5. By this means, convenient access is gained to the mail without requiring the owner to reach to the bottom of the mailbox.

Figure 4:
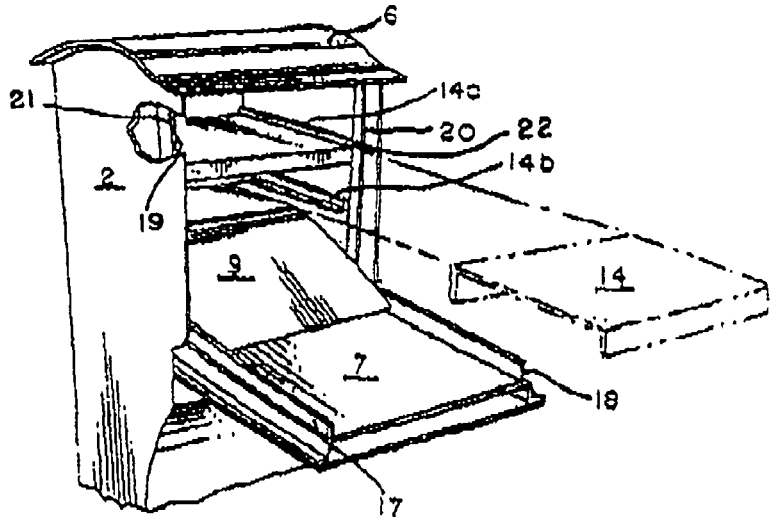
FIG. 4 is a perspective view showing operation of the mailbox.

In order to provide means for depositing mail for pick up by the carrier, tray 14 is positioned on upper flanges 14*a* secured to the interior of the mailbox and as best shown in FIG. 4. In this position, mail to be picked up is positioned on tray 14 and any delivered mail slides down security barrier 9 into the interior of the mailbox. If it is desired to retrieve delivered mail from the front of the mailbox rather than by means of rear access door 10, tray 14 is removed from the mailbox, rotated and repositioned on lower flanges 14*b*. In this manner all incoming and outgoing mail is deposited on tray 14. Although not shown, flanges are secured to the inner surface of side wall 2 corresponding to flanges 14*a* and 14*b*.

To provide ventilation for the interior of the mailbox, horizontal air vents 15 and 16 are provided in back wall 4. For the purpose of preventing water from seeping into the interior of the mailbox, front access door flanges 17 and 18 are disposed adjacent channels 19 and 20 of side walls 2 and 3, respectively, when front access door 7 is closed. Channels 19 and 20 are formed by flanges 21 and 22, each of which is secured along one side edge to the inside of the associated side wall 2 and 3. The free edge portions of flanges 21 and 22 are each spaced from the associated side wall to form channels 19 and 20, respectively. Any excess water entering around front access door 7 simply flows down through channels 19 and 20 disposed outwardly of flanges 17 and 18. Similar structure is associated with rear access door 10 in the form of rear access door flanges 17*a* and 18*a* and channels 19*a* and 20*a* as shown in FIG. 5.

In order to secure the mailbox to the ground, mounting means in the form of plate 23 and post 24 are provided wherein post 24 is inserted into the ground and bottom 5 of the mailbox secured to plate 23 by means of conventional bolts 25. Pins 26 are attached to post 24 in order to prevent unwanted withdrawal of the mailbox.

In operation, when outgoing mail is placed in the mailbox, front access door 7 is simply rotated open by means of handle 27 and the mail placed on tray 14. When the carrier delivers mail, he simply removes the outgoing mail in tray 14 and places the incoming mail on front access door 7. Access door 7 is then closed wherein the delivered mail slides downwardly along security barrier 9 when barrier 9 moves to the position shown in solid lines in FIG. 3. By this means, the mail simply drops onto tray 13 or, if desired, drops onto the bottom of the mailbox. Whenever front access door 7 is opened, security barrier 9 rotates upwardly to the position shown in dotted lines in FIG. 3 thereby preventing access to any mail in the mailbox. In order to retrieve the mail, rear access door 10 is unlocked and rotated open and the mail retrieved.

Therefore, by this invention, a mailbox is provided by which delivered mail is securely maintained with unwanted access thereto prevented. Unlike conventional mailboxes wherein access is easily achieved, by this invention, mail theft is virtually eliminated.

The invention claimed is:

1. A mailbox comprising a front wall, a pair of side walls a back wall a bottom a top a front access door hingedly connected to an upper portion of the front wall, said front access door having flanges along its sides, a rear access door hingedly connected to said back wall and being disposed below said front access door, said rear access door having flanges along its sides, a first tray removably positioned on at least two flanges secured to the inner surfaces of said side walls, at least two additional flanges positioned below said two flanges for alternatively receiving said first tray said side walls having front edges a pair of vertically disposed channels disposed respectively inwardly of said front edges of said side walls and outwardly of said flanges of said front access door when said front access door is closed, and each of said channels being formed by a respective flange secured alone one edge thereof to the inside surface an the associated side wall and a free edge of the flange being spaced from said inside surface of the associated side wall, whereby any water entering around said front access door will flow down through said channels.

2. A mailbox according to claim 1 wherein a security barrier is secured to the inner surface of said front access door and angularly disposed thereto.

3. A mailbox according to claim 1 wherein a second tray is removably positioned below said first tray adjacent a lower portion of said rear access door.

4. A mailbox according to claim 1 wherein an air vent is formed in said back wall.

5. A mailbox according to claim 1 wherein a pair of channels extend adjacent the flanges of said rear access door.

6. A mailbox according to claim 1 wherein a mounting post is secured in the ground, a plate is secured to an upper portion of said post, and said bottom wall is secured to said plate.

* * * * *